United States Patent [19]

Brown, Jr.

[11] Patent Number: 4,945,704

[45] Date of Patent: Aug. 7, 1990

[54] CONCRETE ANCHOR AND METHOD OF ATTACHING ELEMENTS TO CONCRETE SLABS

[76] Inventor: Linn P. Brown, Jr., c/o Utility Products Company, 967 Penn Cir., Suite D-107, King of Prussia, Pa. 19406

[21] Appl. No.: 347,100

[22] Filed: May 3, 1989

[51] Int. Cl.[5] ..... E04C 5/20

[52] U.S. Cl. ..... 52/706; 52/699; 52/704; 52/707

[58] Field of Search ..... 52/699, 704–708, 52/678–685, 125.5

[56] References Cited

U.S. PATENT DOCUMENTS

| | | | |
|---|---|---|---|
| 874,413 | 12/1907 | Lyon | 52/706 |
| 923,188 | 6/1909 | Kneas | 52/706 X |
| 1,004,226 | 9/1911 | Ahern | 52/706 |
| 1,022,826 | 4/1912 | Chatfield | 52/704 X |
| 1,241,827 | 10/1917 | Davis | 52/704 |
| 1,265,064 | 5/1918 | Donley | 52/707 X |
| 1,767,066 | 6/1930 | Goldsmith | 52/704 X |
| 1,922,479 | 8/1933 | Joslin | 52/699 X |
| 3,405,497 | 10/1968 | McNair | 52/699 |
| 3,420,014 | 1/1969 | Courtois et al. | 52/706 X |

FOREIGN PATENT DOCUMENTS

| | | | |
|---|---|---|---|
| 715755 | 8/1965 | Canada | 52/704 |
| 2006314 | 5/1979 | United Kingdom | 52/685 |

*Primary Examiner*—Richard E. Chilcot, Jr.

*Attorney, Agent, or Firm*—Panitch Schwarze Jacobs & Nadel

[57] ABSTRACT

A cup-shaped anchor is provided which has a large pullout resistance because it translates vertical pullout force placed on the anchor into lateral stress within the concrete slab. Preferably, the anchor is frustoconical and provided with two pairs of oppositely aligned holes located in the walls of the anchor which slant generally outwardly from its base. Bracing bars are preferably inserted through the holes to both reinforce the concrete slab and further increase the pullout resistance of the anchor. Preferably the bracing bars are separate, electrically non-conducting bars to electrically isolate the anchor and support members. The anchor permits elements to be attached to a face of a concrete slab by means of a threaded hole which is sealed against concrete entering during pouring.

20 Claims, 1 Drawing Sheet

FIG. 1
PRIOR ART
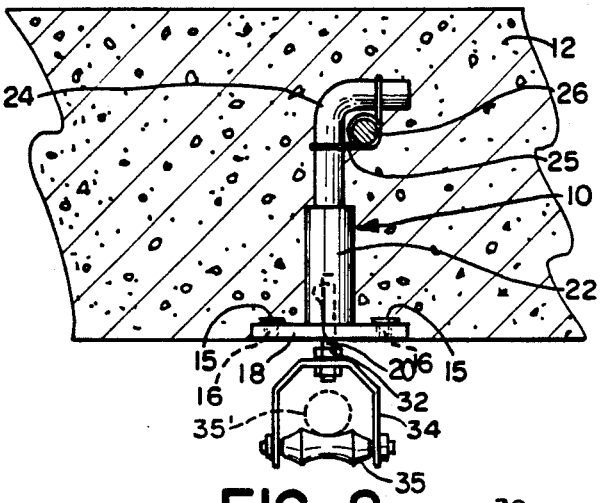
FIG. 2
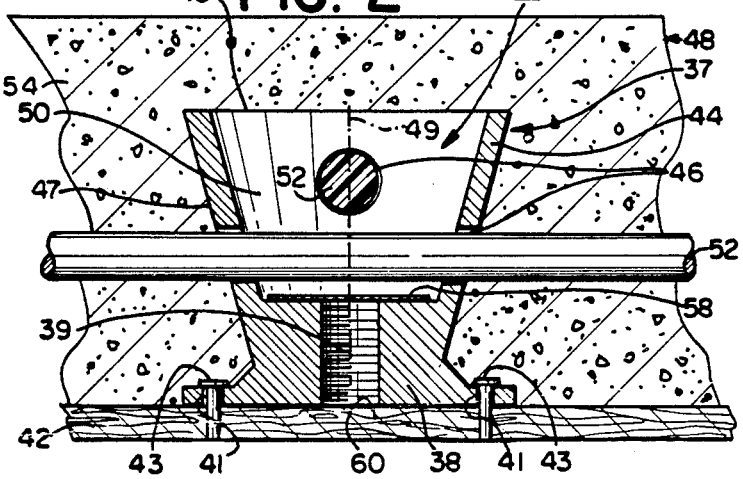
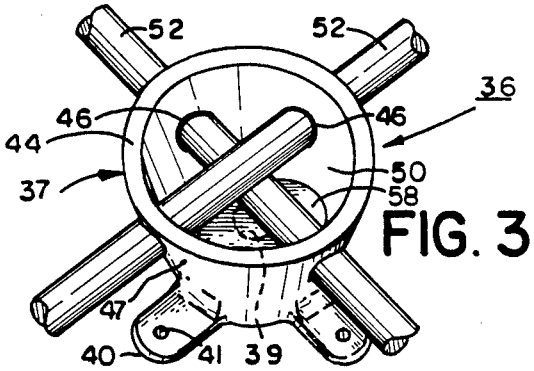
FIG. 3

CONCRETE ANCHOR AND METHOD OF ATTACHING ELEMENTS TO CONCRETE SLABS

FIELD OF THE INVENTION

The present invention generally relates to an anchor for embedding in concrete for attaching elements to the concrete. Additionally, the invention relates to a method for embedding the anchor into a concrete slab in a reinforced or braced manner.

BACKGROUND OF THE INVENTION

It is often desirable to attach various types of elements to variously proportioned concrete slabs. For example, one may wish to suspend pipes, cables or other equipment from the underside of a concrete bridge deck or other poured concrete ceilings. One commonly used insert or anchor is a cast cylindrical member with an axially drilled threaded hole for screwing in pipe hangers and the like, with outer projections and/or circumferential ridges to resist pulling of the anchor out of the concrete.

Another anchor or insert has a flat rectangularly-shaped base with a threaded hole in its center and an inversely L-shaped bolt extending upwardly from its base as shown in FIG. 1. The base of the insert is nailed to a wooden form with the inversely L-shaped bolt being hand-wired to a reinforcing bar. Concrete is then poured into the wooden form. Once the concrete cures, the form is removed leaving the inversely L-shaped bolt embedded in the concrete slab and the threaded hole in its base exposed and ready for use.

A problem encountered in using such anchors is that due to their shape, the anchors stand the risk of pulling out of the concrete slab if a sudden or extreme force, such as would be caused by an earthquake, explosion, ship collision into a bridge, or even heavy traffic vibration, is applied to it.

SUMMARY OF THE INVENTION

The present invention is directed to the attachment of elements to a concrete slab by use of an anchor inherently stronger than conventional anchors and having the capacity to withstand sudden or extreme vertical forces, thus reducing the possibility of the anchor and elements attached to it being pulled out of the concrete slab.

In one aspect, the invention comprises an anchor for attaching elements to a face of a concrete slab comprising a cup-shaped, one-piece body having a base and walls extending from the base to form an open end of the body, said base defining an outer transverse surface of said body and said base and walls together defining an outer side surface of said body sloping outwardly directly from said outer transverse surface, all about said outer transverse surface, to said open end, said body further including means extending from the base for mounting the body to a form for pouring the concrete slab, and means for attaching elements to said anchor.

Aperture means are also preferably provided in the walls of the anchor to facilitate the insertion of bracing bars. Preferably the bracing bars are non-electrically conducting for electrically isolating the anchor from electrically conductive elements, like steel reinforcement bars, in the concrete.

According to the method aspect of the invention for attaching elements to a face of a concrete slab using an anchor in said slab and including the steps of fastening the anchor to a form for said slab and pouring concrete into said form around said anchor, an improvement comprises the step of fastening to said form an anchor comprising a cup-shaped, one-piece body having a base and walls extending from the base to form an open end of the body, said base defining an outer transverse surface of said body and said base and walls together defining an outer side surface of said body sloping outwardly directly from said outer transverse surface, all about said outer transverse surface, to said open end, said body further including means extending from the base for mounting the body to a form for pouring the concrete slab, and means for attaching elements to said anchor. Concrete is then poured into said open end as well as around said anchor.

BRIEF DESCRIPTION OF THE DRAWINGS

The foregoing summary, as well as the following detailed description will be better understood when read in conjunction with the appended drawings. For the purpose of illustrating the invention, there is shown in the drawings an embodiment which is presently preferred, it being understood, however that this invention is not limited to the precise arrangement and instrumentalities shown.

FIG. 1 is an elevation view, partially in cross section, of a prior art anchor embedded in a concrete slab;

FIG. 2 is a cross sectional elevation view of the preferred embodiment of an anchor according to the present invention embedded in concrete before the form is removed, but with the concrete removed from inside the anchor for illustration purposes; and FIG. 3 is a top perspective view of the anchor of FIG. 2 with reinforcing bars but without the concrete.

cl DESCRIPTION OF A PREFERRED EMBODIMENT

Referring to the drawings, in detail, where like numerals indicate like elements throughout, there is shown in FIG. 1 an elevation view of a concrete insert 10 in accordance with the prior art. In this embodiment, the insert 10 is employed to facilitate the attachment of an element, for example, a hanger 34 and hanger rod 32, to the face of a concrete slab 12.

The insert 10 is fastened to a form (not shown) by nails or screws 15 (shown cut off after removal of form). The nails or screws 15 are inserted into nailing holes 16 located in the flat, rectangularly shaped washer plate 18 which has a threaded hole 20 in its center. Extending upwardly from the washer plate 18 is a hollow member 22 of cylindrical or hexagonal shape, for example, which is threaded on the inside, with one end of the member 22 being welded to the washer plate 18. An L-shaped angle bolt 24 is attached with a three-hundred-sixty degree weld or other suitable connection to the upper end of the member 22 as shown in FIG. 1.

Prior to pouring the concrete, the angle bolt 24 is wired 25 to a reinforcing bar (rebar) 26 which passes through the bight of the angle bolt 24. The insert 10, which is fastened to the form (not shown), via its nailing holes 16 located in the washer plate 18, is then immersed in concrete which is poured into the form and cured to form the concrete slab 12. After curing the concrete, the form is removed leaving the threaded hole 20 exposed. A hanger rod 32 with attached pipe hanger 34 is then screwed into the threaded hole to facilitate the hanging of pipes (not shown) from the lower face of the concrete slab 12. Various forms and arrangements of pipe hangers and hanger rods have been used in the art, as illustrated for example by U.S. Pat. Nos. 1,476,473, 3,003,726 and 3,769,190, incorporated by reference. The last patent discloses the use of a dielectric, non-electrically conducting roller 35 for electrically isolating a supported member 35' (in phantom) from the hanger 34 and insert 10.

There are a number of disadvantages associated with the use of the insert 10. The angle bolt 24 of the insert 10 must be manually wired to the reinforcing bar (rebar) before the concrete is poured into the form. Failure to wire the angle bolt 24 to the reinforcing bar 26 or improper wiring reduces the pullout resistance of the insert 10. Therefore, use of the insert 10 introduces the element of human error and thus increases the possibility of the insert 10 being pulled out of the concrete slab 12 if severe force is applied to it. Furthermore, unless cast or formed as an integral piece, the member 22 of the insert 10 is vulnerable to separation at both its ends at the connections to the washer plate 18 and to the angle bolt 24. This, therefore, serves to further decrease the pullout resistance of the insert 10 and any severe force applied to the insert 10 may break the connections and cause the hung elements 32, 34 to be detached from the slab 12. Further, the angle bolt 24 may straighten out upon exertion of pullout force, leaving the anchor unsecured. Other disadvantages will be apparent to those skilled in the art.

Turning to the present invention, there is shown in FIG. 2 an elevation view of an anchor 36 in accordance with the invention. In this embodiment, the anchor 36 is employed to facilitate the attachment of an element, such as shown in FIG. 1 with the prior art insert, to the face of a concrete slab 48.

The anchor 36 of the present invention comprises a cup-shaped, one-piece body 37, preferably made of a corrosion-resistant material such as stainless steel, having a base 38 and walls 44. The walls 44 extend transversely from the base 38 to form an open end 45 and an exposed, hollow portion or cavity 50 in the body 37. The base 38 includes means for attaching elements to the anchor 36 in the form of a threaded aperture 39 which is generally centrally axially positioned in the body 37 and the base 38. The threaded aperture 39 facilitates the screwing in of an element such as a hanger and rod assembly (not shown) from which pipes or other equipment may be suspended. It should be understood that although a threaded aperture is shown in connection with the present embodiment, any other suitable type of element attachment means can be employed.

The base 38 preferably includes means for mounting the anchor on a form 42 into which concrete is poured. The mounting means will keep the anchor in place while pouring and curing the concrete. In the present embodiment a plurality of apertured protrusions 40 (best seen in FIG. 3), extend laterally from the base 38, for the purpose of mounting anchor 36 to form 42. The mounting is accomplished, for example, by inserting nails 43 through the nailing holes or apertures 41 in the protrusions 40 and into the form 42 as shown in FIG. 2 so that the base 38 and its outer transverse surface 60 will be adjacent the face of the concrete slab 38 and the walls 44 will extend from the base 38 into the slab 48.

In the present embodiment, there are four apertured protrusions 40 arranged at right angles to each other around the base member 38 through which nails 43 are inserted. However, it should be understood that any other suitable number or type of mounting means, or none at all, can be employed.

Together, the walls 44 with the exposed radial sides of the base 38, define an outer side surface 47 of the body 37. The outer side surface 47 extends from the outer transverse surface 60 of the base 38 to the open end 45. It is the design of the walls 44 and exposed circumferential portion of the base 38 (both generally slanting outwardly) which causes vertical forces placed on the anchor 36 to be transferred to the concrete slab 48 to place the concrete slab 48 in compression laterally all around the anchor 36, thus reducing the risk of the anchor 36 pulling out of concrete slab 48.

In particular, the body 37 is preferably frustoconical. The outer side surface 47 slopes generally outwardly directly from the outer base surface 60, all about the exterior base surface 60, with circular, transverse (horizontal in FIG. 2) cross sections. This uniformly loads the concrete in compression in the plane of the slab 48 all around the body 37 and maximizes the lateral compressive forces placed on the slab 48 (i.e. forces in the plane of the slab 48) for the height of the body 37. Stated in another way, the preferred, frustoconical shape minimizes the necessary height of the body 37 for achieving the predetermined support forces. Preferably, the outer side surface 47 forms an angle of less than forty-five degrees with a central axis 49 to impose a greater load laterally into the plane of the slab 48 than is directed onto the concrete directly below the anchor 36. In the depicted embodiment, the axis 49 is an axis of rotation of the body 37, base 38, threaded aperture 39 and walls 44 and is perpendicular to the outer transverse surface 60 and the face of the slab 48. Preferably, the outer side surface 47 forms an angle of about fifteen degrees with respect to the central axis 49 (i.e. about a thirty degree cone angle).

While the anchor 36 is shown in FIG. 2 without concrete 54 in the hollow portion 50 (for ease of illustration), in actuality the hollow portion 50 would be full of concrete when installed. This further prevents the anchor walls 44 from collapsing under compression.

In the preferred embodiment of FIGS. 2 and 3, the anchor 36 is basically frustoconical. However, the outward slant of the walls 44 of the anchor 36 need not be continuous. The walls 44 may at any point curve or run horizontally or vertically, but must at some point extend outwardly. Various shaped walls will be evident from the present disclosure. Further, while a generally circular transverse cross section is preferred, it will be understood that elliptical or polygonal transverse cross sectional shapes could be used.

The anchor 36 includes bracing means which comprises aperture means in the walls 44. In the present embodiment, the preferred aperture means comprises two pairs of holes 46 located in the walls 44 of the anchor 36. The holes 46 permit some connection between the concrete lying against the outer side surface 47 and the concrete within the hollow portion 50. The bracing means preferably further comprises one or, more preferably, a pair of bracing bars 52, each inserted through one of the pairs of holes 46. The holes 46 of each pair are aligned on diametrically opposite sides of the walls 44 to support each of the bars 52 generally diametrically through the body 37 and generally parallel to the concrete slab 48 and exterior base surface 60 as shown in FIGS. 2 and 3. The two, diametric pairs of holes 46 are preferably aligned at right angles to one another so that axes through each of the pairs (represented by bars 52 in the FIGS. 2 and 3) are generally perpendicular to one another and spaced axially from one another to permit the cross shaped installation of the bracing bars 52 shown in FIG. 3.

These bracing bars 52 preferably are also made of a corrosion resistant material and may be either reinforcing bars ("rebars"), which would normally be used to reinforce the concrete slab 48, or may be separate, additional bars. Preferably, the bracing bars 52 are separate, additional bars of dielectric material, for example fiber reinforced polymer or glass rods, so as to be non-electrically conducting and to electrically isolate the anchor 36 from the metal reinforcing framework (rebars) of the slab 48. When used with an insulating support hanger like that disclosed in U.S. Pat. No. 3,769,190, incorporated by reference, redundant electrical isolation is provided between a metal pipe or other electrically conducting element being supported by the hanger and the electrically conductive rebar network of the concrete slab 48.

The preferred anchors 36 of the present invention are most useful in supporting heavy piping from concrete decks, such as bridge decks, even in salt water environments. For example, anchors of the present invention have been used in pairs at ten (10) foot intervals along twenty-four inch diameter, water-filled iron pipe, to support the pipe from the lower surfaces of concrete bridge decks.

While preferably cast of stainless steel, the bodies 37 of the anchors 36 of the present invention can be machined and can be formed of other materials, including ductile iron. Where metal bracing rods 52 are used, they should be of the same metal and preferably the same grade of metal as the body 37 to minimize or entirely avoid electrolysis.

As will be understood by those skilled in the art, the bracing bars 52 provide additional pullout resistance for the anchor 36 as well as stability during pouring of the concrete. For this purpose the bracing bars 52 should extend beyond the exterior of walls 44. That is, the bars 52 should be longer than the maximum diameter of the anchor 36 at the point of insertion, and preferably multiples of that diameter, to spread the weight being supported by the anchor 36 over a larger area of the slab 48.

It should be understood that, while two pairs of holes 46 with separate bracing bars 52 inserted through them are used to increase the pullout resistance of the anchor 36, any other suitable type of bracing means, or none at all, can be employed. For example, the walls 44 could additionally be provided with various types of protrusions or extensions.

The base member 38 further includes sealing means, in the present embodiment a rigid disk 58 inserted in the cavity 50 of anchor 36 and fastened, for example, by gluing over the threaded aperture 39, to prevent concrete 56 from entering into the threaded aperture 39. It should be understood that, while a rigid disk 58 is employed in connection with the present embodiment, any suitable type of sealing means can be employed. Alternatively, the threaded hole 39 may stop short of the interior (upper) surface of base 38 to avoid the necessity of a seal.

While various size anchors may be made according to the invention, a convenient size for many applications is about three-and-one-half inches high, about four inches in diameter at the open end 45 and through opposing pairs of the apertured protrusions 40, and about two inches in diameter at the outer transverse surface 60. Preferably, the threaded aperture is longer (deeper) than its diameter, the diameter accommodating hanger rod sizes of about three-fourth inch to one-and-one-half inches in diameter. Preferably, the bracing bars 52 are at least about one foot in length and about five-eighths of an inch in diameter. Tests have shown such an anchor cast from Type 316 stainless steel with two, one-foot long dielectric bracing bars to be able to support at least twenty-eight thousand pounds with no apparent damage. The test in question concluded with fracture of the concrete block, indicating greater loads are capable of being supported by the anchor 36 with stronger concrete. The combination of a stainless steel body 37 and dielectric bracing bars such as fiber reinforced plastic rod are particularly suited for use in salt environments, such as seashore areas and bridge decks which are salted to prevent freezing.

According to the method of the invention, a series of anchors 36 are fastened to a form 42 at suitable intervals as known in the art by means of the apertured protrusions 40. Nails or screws 43 are inserted through the nailing holes 41, thus fastening each anchor 36 to the form 42. The threaded aperture 39, located in the base member 38 of the anchor 36, is sealed at the end furthest removed from the outer transverse surface 60 of the base 38, for example, by inserting and preferably gluing (e.g., with a hot melt adhesive) a rigid disk 58 into the cavity 54 of the anchor 36. Preferably, the disk 58 is sealed in place at the factory rather than in the field, to avoid workmen forgetting to insert the disk prior to pouring the concrete.

Preferably, two bracing bars 52 are then inserted through two pairs of oppositely aligned holes 46 in the walls 44 of the anchor 36. No wiring of the bars 52 to the anchors 36 is required. The bars 52 are preferably a foot or longer in length, but shorter bars may be used in tight corners.

Concrete is then poured into the form 42 and into the hollow interior 50 of each anchor 36 where it is left to cure. Once cured, the form 42 is removed and the nails or screws 43 are sheared off so that they are flush with the face of concrete slab 48 of FIG. 2. Elements such as pipes are then attached to the anchor 36 by a hanger and rod assembly (not shown) screwed into the threaded aperture 39.

This method may be used to attach elements to the side or top face of a concrete slab, as well as to the bottom face as shown in FIGS. 1 and 2. For example, exterior ornaments may be attached to the sides of buildings or guy wires may be attached to concrete sidewalks or other pavements to stabilize trees or other structures such as radio towers. Further, while the invention has been described in connection with concrete slabs, it will be understood that concrete is used herein to refer generically to any solid embedding material including, for example, asphalt or synthetic composition building or construction materials.

Under full load, the taper of the frusto-conical body 37 alone prevents the anchor 36 of the invention from sliding out of a concrete slab 48. A pullout would have to take with it a large section of the concrete slab 48 because vertical pull-out force is translated into lateral compressive stresses within the concrete, placing the concrete in uniform compression for a full three-hundred-sixty degrees around the anchor 36. This force could not collapse the body 37 because of its own inherent strength and because the hollow portion 50 would be full of concrete. Therefore, the pullout strength of the anchor 36 of the invention, even without bracing bars 52, is greater than the conventional insert, and with the two bracing bars 52 in position, it would be virtually impossible for it to fail even under a catastrophic scenario. As a result, the anchor 36 of the invention is capable of supporting unusually great loads.

It will be recognized by those skilled in the art that changes may be made to the above-described embodiment of the invention without departing from the broad inventive concepts thereof. It is understood, therefore, that this invention is not limited to the particular embodiment disclosed, but it is intended to cover all modifications which are within the scope and spirit of the invention as defined by the appended claims.

I claim:

1. An anchor for attaching elements to a face of a concrete slab comprising a cup-shaped, one-piece body having a base and walls extending from the base to form an open end of the body, said base defining an outer transverse surface of said body and said base and walls together defining an outer side surface of said body sloping outwardly directly from said outer transverse surface, all about said outer transverse surface, to said open end, said body further including means extending from the base for mounting the body to a form for pouring the concrete slab, and means for attaching elements to said anchor.

2. The anchor of claim 1 wherein said mounting means comprises a plurality of apertured protrusions extending laterally from said base.

3. The anchor of claim 1 further comprising aperture means in said walls for bracing the anchor in the concrete slab.

4. The anchor of claim 3 wherein the aperture means comprises a first pair of diametrically opposed holes through the walls, the first pair of holes being positioned to support a bracing bar diametrically through the body.

5. The anchor of claim 4 further comprising a bracing bar through the first pair of diametrically opposed holes.

6. The anchor according to claim 5 wherein the bracing bar is non-electrically conducting.

7. The anchor of claim 4 comprising a second pair of diametrically aligned holes through the walls, the second pair of holes being positioned perpendicular to and axially spaced from the first pair of holes.

8. The anchor of claim 7 further comprising two bracing bars, each bar passing through a separate pair of the holes.

9. The anchor of claim 7 wherein each bracing bar is non-electrically conducting.

10. An anchor for attaching elements to a face of a concrete slab comprising:

(a) a frustoconical shaped, one-piece body having a base and walls slanting outwardly from said base towards an open end of said body, said body being made of a corrosion-resistant material;

(b) mounting means extending laterally from said base for attaching the anchor by the base to a form for pouring said concrete slab;

(c) attachment means for attaching elements to said anchor; and (d) bracing means for bracing said anchor in said concrete slab, said bracing means comprising a pair of oppositely aligned holes through said walls.

11. The anchor of claim 10 wherein the body is formed of stainless steel.

12. The anchor of claim 10 wherein the body has an outer side wall forming a cone angle of about thirty degrees.

13. The anchor of claim 10 further comprising a non-electrically conducting bracing bar through the pair of holes.

14. In a method for attaching elements to a face of a concrete slab using an anchor in said slab and including the steps of fastening the anchor to a form for said slab and pouring concrete into said form around said anchor, an improvement comprises the steps of fastening to said form an anchor comprising a cup-shaped, one-piece body having a base and walls extending from the base to form an open end of the body, said base defining an outer transverse surface of said body and said base and walls together defining an outer side surface of said body sloping outwardly directly from said outer transverse surface, all about said outer transverse surface, to said open end, said body further including means extending from the base for mounting the body to a form for pouring the concrete slab, and means for attaching elements to said anchor and pouring concrete into said open end as well as around said anchor.

15. The method of claim 14 wherein the anchor further has a plurality of holes in the walls and further comprising the step of inserting a non-electrically conducting bracing bar through a first pair of the holes before the pouring step, the anchor being spaced from any electrically conducting rebars in the slab for electrical isolation of the body in the slab.

16. The method of claim 15 wherein two non-electrically conducting bracing bars are inserted through two pairs of holes in said walls, the holes of each pair being oppositely aligned with axes through each of said pairs of holes being at substantially right angles to each other.

17. The method of claim 14 wherein said threaded opening is sealed at the end furthest removed from the exterior surface of said base by insertion of a disk into the cavity of said anchor prior to pouring of said concrete into said form.

18. The method of claim 14 wherein the anchor body has a frustoconical shape.

19. The method of claim 15 wherein the anchor body has a frustoconical shape.

20. The method of claim 14 wherein the base includes means for attaching elements to the anchor and further comprising the step of attaching hanger means to the base with the attaching means, the hanger means supporting and electrically isolating a supported member from the anchor.

* * * * *